US007783239B2

(12) United States Patent
Yamanaka et al.

(10) Patent No.: US 7,783,239 B2
(45) Date of Patent: Aug. 24, 2010

(54) FUSER UNIT AND IMAGE FORMING APPARATUS EQUIPPED WITH THE SAME

(75) Inventors: Takashi Yamanaka, Nara (JP); Kimihide Tsukamoto, Osaka (JP); Tatsuya Shinkawa, Nara (JP); Kan Mukai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 212 days.

(21) Appl. No.: 12/046,529

(22) Filed: Mar. 12, 2008

(65) Prior Publication Data

US 2008/0226315 A1 Sep. 18, 2008

(30) Foreign Application Priority Data

Mar. 14, 2007 (JP) ..... 2007-065633

(51) Int. Cl.
*G03G 21/00* (2006.01)
*G03G 15/00* (2006.01)
*G03G 15/20* (2006.01)

(52) U.S. Cl. ..... 399/327; 399/34; 399/71; 399/320; 399/326

(58) Field of Classification Search ..... 399/69, 399/326, 327

See application file for complete search history.

(56) References Cited

U.S. PATENT DOCUMENTS 5,970,298 A * 10/1999 Seki et al. ..... 399/327
6,427,060 B1 7/2002 Arakawa et al.
6,944,419 B2 * 9/2005 Kawamoto et al. ..... 399/327
7,433,638 B2 * 10/2008 Ide et al. ..... 399/327
7,565,101 B2 * 7/2009 Yamanaka et al. ..... 399/323

FOREIGN PATENT DOCUMENTS

| | | |
|---|---|---|
| JP | 58-182673 | 10/1983 |
| JP | 2000-98786 | 4/2000 |
| JP | 2001-005327 | 1/2001 |
| JP | 2005-024619 | 1/2005 |
| JP | 2006-106347 | 4/2006 |

* cited by examiner

*Primary Examiner*—David M Gray
*Assistant Examiner*—Francis Gray
(74) *Attorney, Agent, or Firm*—Renner, Otto, Boisselle & Sklar, LLP

(57) ABSTRACT

A fuser unit for an image forming apparatus including: a tape-like cleaning member that abuts on a fuser roller and cleans its peripheral surface; a press roller that presses the fuser roller via the cleaning member; a feed roller that feeds said cleaning member; a wind roller that winds the cleaning member therearound; and a controller that actuates a fixing function before an image formation, stops it after said image formation, and rotates and stops the wind roller and/or the feed roller to control a winding quantity of the cleaning member, wherein said controller calculates a toner image amount based on the prescribed number of pages by tracking from a page on which an image is formed just before the image formation is completed, and determines whether or not said cleaning member is wound around the wind roller during a non-fixing period based on the calculated toner image amount.

8 Claims, 7 Drawing Sheets

FUSER UNIT AND IMAGE FORMING APPARATUS EQUIPPED WITH THE SAME

CROSS-REFERENCE TO RELATED APPLICATION

This application is related to Japanese application No. 2007-065633 filed on Mar. 14, 2007 whose priority is claimed under 35 USC §119, the disclosure of which is incorporated by reference in its entirety.

BACKGROUND OF THE INVENTION

1. Field of the Invention

The present invention relates to a fuser unit and an image forming apparatus equipped with the same. More specifically, the fuser unit includes a cleaning part of a web cleaning system.

2. Description of the Related Art

As a mechanism for reducing a toner remaining on a surface of a fuser roller in an image forming apparatus, a web cleaning system is known. Further, a fuser cleaning device has been proposed, for optimizing a moving amount of a cleaning member according to a contamination degree of the surface of the fuser roller by changing a moving amount of a cleaning member (cleaning web) according to a print ratio (for example, see Japanese Patent Laid Open No. 2001-5327).

SUMMARY OF THE INVENTION

The present invention provides a fuser unit for an image forming apparatus which provides a fixing function of fusing a toner and fixing it on a recording sheet by use of a fuser roller, the fuser unit including: a tape-like cleaning member that abuts on the fuser roller, and cleans its peripheral surface; a press roller that presses the fuser roller via the cleaning member abutting on said peripheral surface of the fuser roller, and forms a cleaning nip portion which is an area where the cleaning member is pressed against the fuser roller; a feed roller that feeds said cleaning member provided in an originally wound state; a wind roller that winds the cleaning member therearound, which is fed from the feed roller and passes through said cleaning nip portion; and a controller that actuates the fixing function before an image formation is performed by the image forming apparatus, stops it after said image formation is performed, and rotates and stops the wind roller and/or the feed roller to control a winding quantity of the cleaning member, wherein said controller calculates a toner image amount based on the prescribed number of pages by tracking from a page on which an image is formed just before the image formation is completed, and controls so that when the calculated toner image amount is a predetermined amount or more, said cleaning member is wound around the wind roller during a non-fixing period after completing the image formation until next actuating the fixing function, and when said calculated toner image amount is less than the prescribed toner image amount, said cleaning member is not wound around the wind roller during said non-fixing period.

Also, the present invention provides an image forming apparatus equipped with the fuser unit.

One of the technical characteristics of the fuser unit of the present invention is that the controller performs control so that a printing amount of prescribed number of pages back from the page just before the image formation is stopped is calculated, and if the calculated printing amount is a prescribed amount or more, the cleaning member is wound up for replacement of the cleaning member of the cleaning nip portion during the non-fixing period, and if the printing amount does not exceed the prescribed amount, the cleaning member is not wound up during the non-fixing period. By this technical characteristic, it is possible to prevent the toner from remaining in the cleaning nip portion after the image forming process is completed and to prevent the sheet (recording sheet) outputted thereafter from being contaminated by the remaining toner. In addition, it is possible to estimate a contamination degree of the cleaning nip portion based on the printing amount of the prescribed number of pages back from the page just before the image formation is stopped and determine whether the cleaning member should be wound up during non-fixing period according to the contamination degree. In other words, when the contamination in the cleaning nip portion is estimated to be within an allowable range, the cleaning member is not wound up, thus making it possible to save the cleaning member.

Here, what is meant by actuating the fixing function is specifically controlling a temperature of the fuser roller to a temperature capable of fixing the toner to a recording member, and starting rotating the fuser roller. Moreover, what is meant by stopping the fixing function is stopping at least a rotation of the fuser roller. Further, in order to save the power consumption, the temperature of the fuser roller may be controlled to a temperature lower than the temperature capable of fixing the toner, or power supply to a heater for heating the fuser roller may be intercepted.

As preferred example of the timing for winding up the cleaning member in the non-fixing period, the timing is set at a point when an image of a last page is transferred to the recording member and is passed through the fuser roller, in the image formation of a series of pages. As another preferred example of the timing, the timing is set at a point just after stopping the rotation of the fuser roller after the image formation is finished. Further, as another preferable example, the timing is set at a point when a control temperature of the fuser roller is switched to a mode of power saving from a mode capable of fixing the toner.

DETAILED DESCRIPTION OF THE PREFERRED EMBODIMENTS

Figure 1:
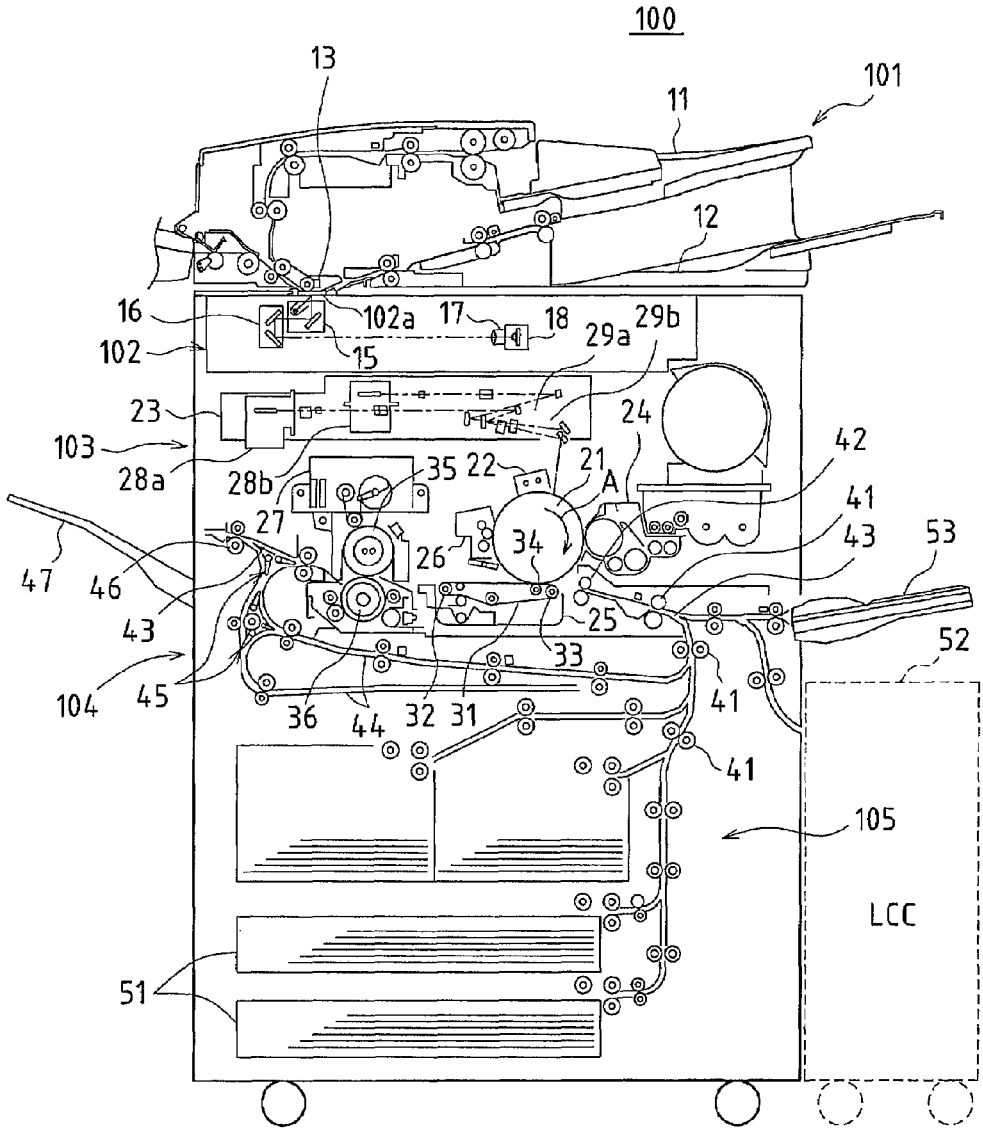
FIG. 1 is an outline view showing an overall structure according to an embodiment of an image forming apparatus that implements a drive control method of the present invention.

When inventors of the present invention study on the fuser cleaning device using the cleaning web, it is found that a sheet contamination occurs when next image forming process is started after finishing the image forming process of a series of pages.

Further study on this problem revealed the following matter. The surface of the fuser roller is set in a high temperature state while the image forming process of a series of pages (including a first page, which is the same hereunder) is continued. Even if the toner remains in an area (cleaning nip portion) where the cleaning member (cleaning web) and the fuser roller are in press contact with each other, the remaining toner is in a molten state and therefore adhesion to the surface of the fuser roller is weak. Accordingly, even if the surface of the fuser roller is moved by its rotation, the remaining toner stays in the cleaning nip portion. Namely, the adhesion to the cleaning member of the toner in the molten state is stronger than the adhesion to the surface of the fuser roller.

However, when no start instruction of the next image formation is given for a prescribed time or more, after the image forming process of a series of pages is completed, a control device of the image forming apparatus stops power supply to a heater for heating the fuser roller, thereby reducing power consumption. A surface temperature of the fuser roller then gradually decreases. If the toner remains in the cleaning nip portion when the image forming process is finished, the remaining toner is solidified on the surface of the fuser roller. The solidified toner adheres to a recording sheet in the next image forming process and is outputted, resulting in a sheet contamination. This reveals that the sheet contamination is caused by the solidified toner which has remained in the cleaning nip portion.

A conventional fuser cleaning device is provided for the purpose of performing a sufficient cleaning in the image forming process. However, it fails in solving a problem that the toner remaining in the cleaning nip portion is solidified after the image forming process is completed.

In view of the above-described circumstance, the present invention is provided, and an object of the present invention is to provide a technique capable of preventing the toner from remaining in the cleaning nip portion and preventing the sheet outputted thereafter from being contaminated by the remaining toner.

Preferred embodiments of the present invention will be explained hereunder.

In the fuser unit according to the present invention, said controller may further rotate the wind roller during said image formation, and said prescribed number of the pages may be the number of pages on which the toner is fixed while a length of the cleaning member corresponding to a length of said cleaning nip portion is wound around the wind roller during said image formation Alternately, as one of the structures, the image is formed on a page while the cleaning member is wound up by a length of the cleaning nip portion. With this structure, it is possible to calculate the printing amount of the page on which the toner is fixed while cleaning is performed by a part positioned in the cleaning nip portion of the cleaning member.

Further, the winding quantity of the cleaning member during the non-fixing period may be a length of the cleaning member which corresponds to a length of said cleaning nip portion. With this structure, it is possible to save the cleaning member without excessively winding up the cleaning member.

Said controller may control said winding quantity of the cleaning member based on an initial radius of the cleaning member wound around the feed roller, an initial radius of the cleaning member wound around the wind roller, an average thickness of the cleaning member, and a cumulative total value obtained by cumulating angle of either the feed roller or the wind roller having rotated since an initial rotation. With this structure, the controller can accurately control a winding quantity by using a previously defined numerical value, without disposing a particular detecting mechanism or detector circuit.

The fuser unit may further include: a driver that rotates said wind roller in a winding direction at a prescribed speed, wherein said controller may control a rotation time of the wind roller rotated by the driver, thereby controlling said winding quantity. With this structure, the controller can accurately control the winding quantity by controlling a time for rotating a wind roller.

The fuser unit may further include: a tension mechanism that enables said wind roller to be capable of slipping, thereby giving tension to the cleaning member; and a braking unit that brakes or rotates said feed roller so that the rotation thereof is adjusted, wherein said controller may change a timing in which said braking unit brakes or rotates the feed roller, thereby controlling said winding quantity. With this structure, the controller can accurately control the winding quantity by controlling the timing for giving or releasing a braking force.

In addition, the image forming apparatus of the present invention may further include: an area coverage providing section that provides the controller in said fuser unit with a toner image coverage ratio of each page on which an image is formed, wherein said controller may acquire the toner image coverage ratio of each page, calculates for each page an amount of a toner which is to be fixed to a recording sheet, based on the acquired toner image coverage ratio and a size of the page, and may determine a sum of each calculated toner amount, as the toner image amount. With this structure, it is possible to calculate the printing amount from a print ratio and a size of each page. Based on the printing amount thus calculated, it is possible to estimate the contamination degree of the cleaning nip portion.

Alternately the image forming apparatus may further include: an area coverage providing section that provides the controller in said fuser unit with a toner image coverage ratio of each page on which an image is formed, wherein said controller may acquire the toner image coverage ratio of each page, and determine the number of pages in which the acquired toner image coverage ratio exceeds a prescribed value as the toner image amount. With this structure, it is possible to calculate the printing amount, excluding the pages under a prescribed toner image coverage ratio, which do not exert large influence on the contamination of the cleaning nip portion. Based on the print ratio thus calculated, the contamination degree of the cleaning nip portion can be estimated.

A plurality of various embodiments shown here can be combined.

The present invention will be described further in detail hereunder, by using the drawings. Note that the explanation given hereunder is shown as examples in all points and should not be interpreted as limiting this invention.

Structure of the Fuser Unit

First, a mechanical structure of the fuser unit of the present invention will be explained.

Figure 2:
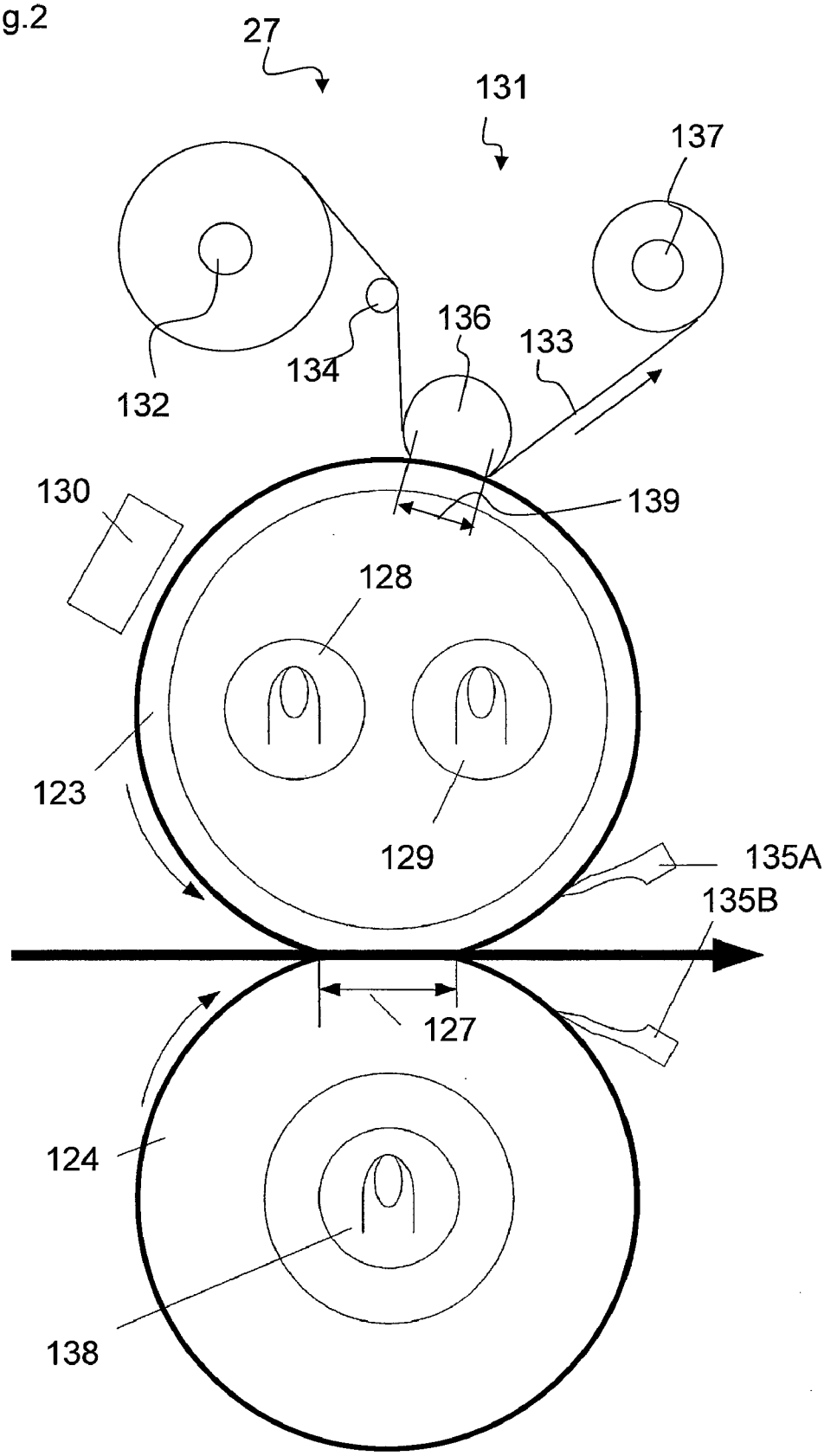
FIG. 2 is an explanatory view schematically showing a structure of a fuser unit of the present invention.

FIG. 2 is an explanatory view schematically showing the structure of the fuser unit of the present invention.

As shown in FIG. 2, a fuser unit 27 is equipped with a pair of heat roller 123 and pressure roller 124. A fuser nip portion 127 is formed in a press-contact part between the heat roller 123 and the pressure roller 124.

The heat roller 123 has an elastic layer on a peripheral surface of a metal core, including inside a main heater 128 and a sub heater 129 formed of a halogen heater lamp. A temperature detector 130 composed of a non-contact type thermistor is disposed around the heat roller 123, so that a surface temperature is controlled to be within a range from 160 to 200° C. by the main heater 128 and the sub heater 129.

In addition, a fuser cleaning unit 131 of a web sheet system for wiping off the remaining toner adhered to an outer peripheral surface of the heat roller 123 is disposed around the heat roller 123.

The fuser cleaning unit 131 is mainly configured with a web sheet feed roller 132, a tension roller 134 for adding a prescribed tension to a web sheet 133 fed from the web sheet feed roller 132, a press roller 136 for making the web sheet 133 in a press-contact state with the outer peripheral surface of the heat roller 23, and a wind roller 137 for winding up the used web sheet.

The fuser cleaning unit 131 is a periodical replacement component to be replaced according to a prescribed replacement cycle.

Meanwhile, similar to the heat roller 123, the pressure roller 124 also has the elastic layer on the peripheral surface of the metal core, including inside a pressure roller heater 138 formed of the halogen heater lamp.

In addition, a separating claw 135A is abutted on the outer peripheral surface of the heat roller 123, and the separating claw 135B is abutted on the outer peripheral surface of the pressure roller 124, respectively, so that a recording sheet that has undergone fixing processing is prevented from winding around the heat roller 123 and the pressure roller 124.

Here, the heat roller 123 corresponds to the fuser roller of the present invention, and the web sheet 133 corresponds to the cleaning member of the present invention. The press roller 136 corresponds to the press roller of the present invention, and the web sheet feed roller 132 corresponds to the feed roller of the present invention. Further, the wind roller 137 corresponds to the wind roller of the present invention.

Winding of the Web Sheet

Figure 3:
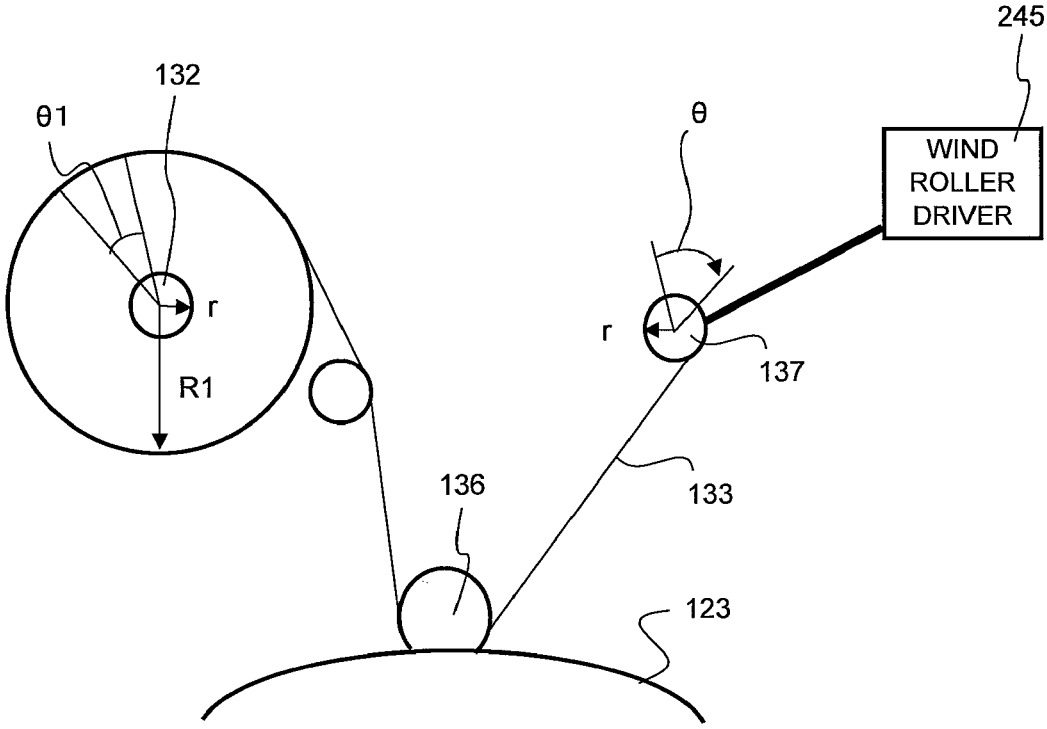
FIG. 3 is an explanatory view schematically showing the structure of a winding mechanism of a web-sheet according to an embodiment of the present invention.

Next, explanation will be given for a winding control of the wind roller 137 by a controller 240 (see FIG. 5). FIG. 3 is an explanatory view schematically showing a winding mechanism of the web sheet.

Each of the wind roller 137 and the feed roller 132 disposed in the fuser unit 27 has an axial radius of "r". In an initial state that a new fuser cleaning unit 131 is fitted, the web sheet in an unused state is wound around the feed roller 132, and the radius of the cleaning member fed from an outermost peripheral side is R1. Although one end of the web sheet is fixed to the wind roller 137, the radius when the web sheet is wound up is substantially equal to radius "r" of a shaft part. The web sheet 133 has a uniform thickness, which is represented by t. Under this condition, a winding quantity wound up to the wind roller 137 by a single winding operation, namely, a feed amount from the feed roller 132 is represented by L(≧Ln). A rotation angle θ of the wind roller 137 rotating for winding up the winding quantity L by a first (n=1) winding (feeding) operation is given by the following formula.

$$\theta - 360 \text{ degrees} \times L/(2\pi r)$$

Meanwhile, the feed roller 132 is rotated following the rotation of the wind roller 137. The feed roller 132 is moved in a peripheral direction by a distance (feeding amount L), which is the same as the distance (winding quantity L) moved by the wind roller 137 in the peripheral direction. This rotation angle θ1 is given by the following formula.

$$\theta 1 = 360 \text{ degrees} \times L/(2\pi R1)$$

Figure 4:
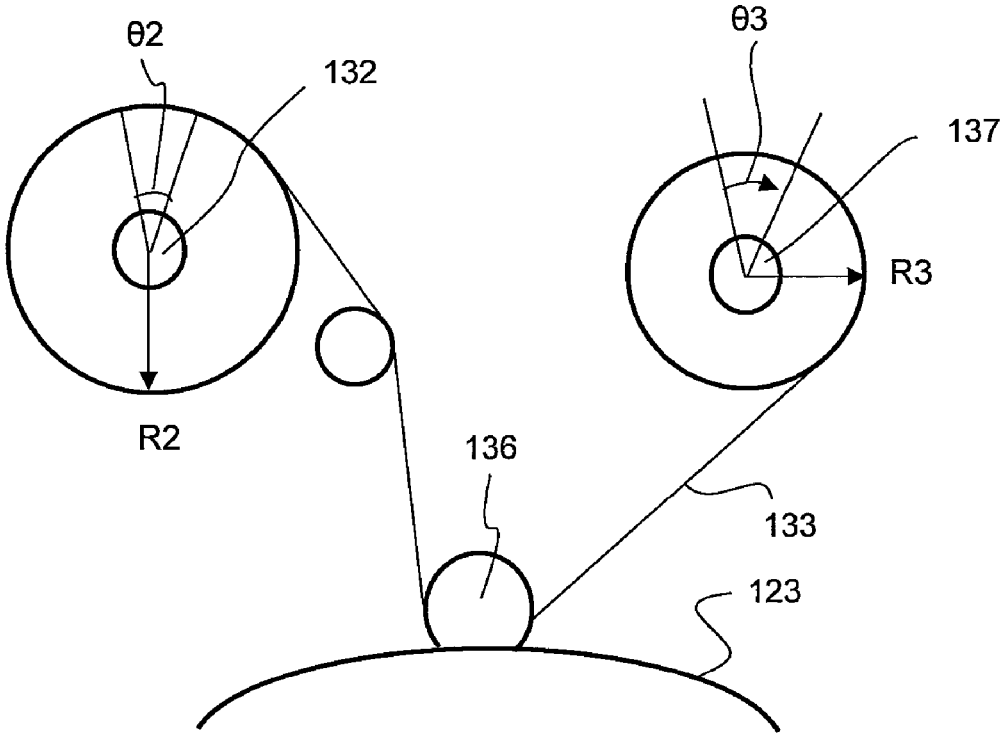
FIG. 4 is an explanatory view showing a state of a fuser roller and a feed roller according to an embodiment of the present invention, when nth winding operation is performed.

Next, explanation will be given for the rotation angle of the wind roller 137 and the rotation angle of the feed roller 132 in the n-th winding operations. FIG. 4 is an explanatory view showing a condition of the wind roller 137 and the feed roller 132 when the n-th winding operations are performed. In FIG. 4, when the web sheet 133 is fed from the feed roller 132, the radius is represented by R2, and when the web sheet 133 is wound up to the wind roller 137, the radius is represented by R3. The rotation angle θ3 of the wind roller and the rotation angle θ2 of the feed roller 132 in the n-th winding operations can be defined as a function of winding (feeding) of "n" execution number of times.

When it is assumed the web sheet is wound up to the wind roller 137 by the winding quantity L in the initial state, the rotation angle of the feed roller 132 is set at θ1=60 degrees, by executing the winding (feeding) operation for n=6 number of times, the feed roller 132 performs one rotation, and one peripheral portion of the web sheet 133 is set in a state of being fed. Therefore, the radius of the wind roller 137 is increased from the initial value r to $[r+t\cdot 2\pi R1/(2\pi r)]$. Meanwhile, the radius of the feed roller 132 is decreased to (R1−t) from the initial value R1.

Similarly, radius R3 of the wind roller 137 in arbitrary n-th time can be obtained as a function F(n) of "n" execution number of times of the winding (feeding). In addition, radius R2 of the feed roller 132 also can be obtained as a function f(n) of "n" execution number of times of winding (feeding).

By obtaining the radius R3 of the wind roller 137, the rotation angle θ3 of the wind roller 137 required for winding up the winding quantity L can be given by the following formula.

$$\theta 3 = 360 \text{ degrees} \times L/(2\pi R3)$$

Thus, the radius R3 can be given as the function of "n" execution number of times of winding, and therefore the rotation angle θ3 also can be obtained as the function of "n" execution number of times. The rotation angle is defined following after the wind roller 137.

The radius R2 and the rotation angle θ2 of the feed roller 132 are given as the function of "n" execution number of times of winding (feeding). The rotation angle θ2 of the wind roller is given by the following formula.

$$\theta 2 = 360 \text{ degrees} \times L/(2\pi R2)$$

Under the controller 240, a motor constituting a wind roller driver 245 is made to carry out uniform speed rotation at a prescribed speed. The rotation angle is proportional to the drive time. The controller 240 measures the drive time of the wind roller by a timer unit 246 and controls its rotation angle. Namely, the controller 240 drives the motor for a time so that the wind roller 137 forms a desired rotation angle θ3, and controls the rotation angle of the wind roller 137. Table data is stored in a memory 242. The contents of the table data is related to the "n" execution number of times, a rotation angle, and a required rotation time for rotating the wind roller 137 by this angle.

EXAMPLE

Control Procedure for Winding Operation of the Web Sheet

Figure 6:
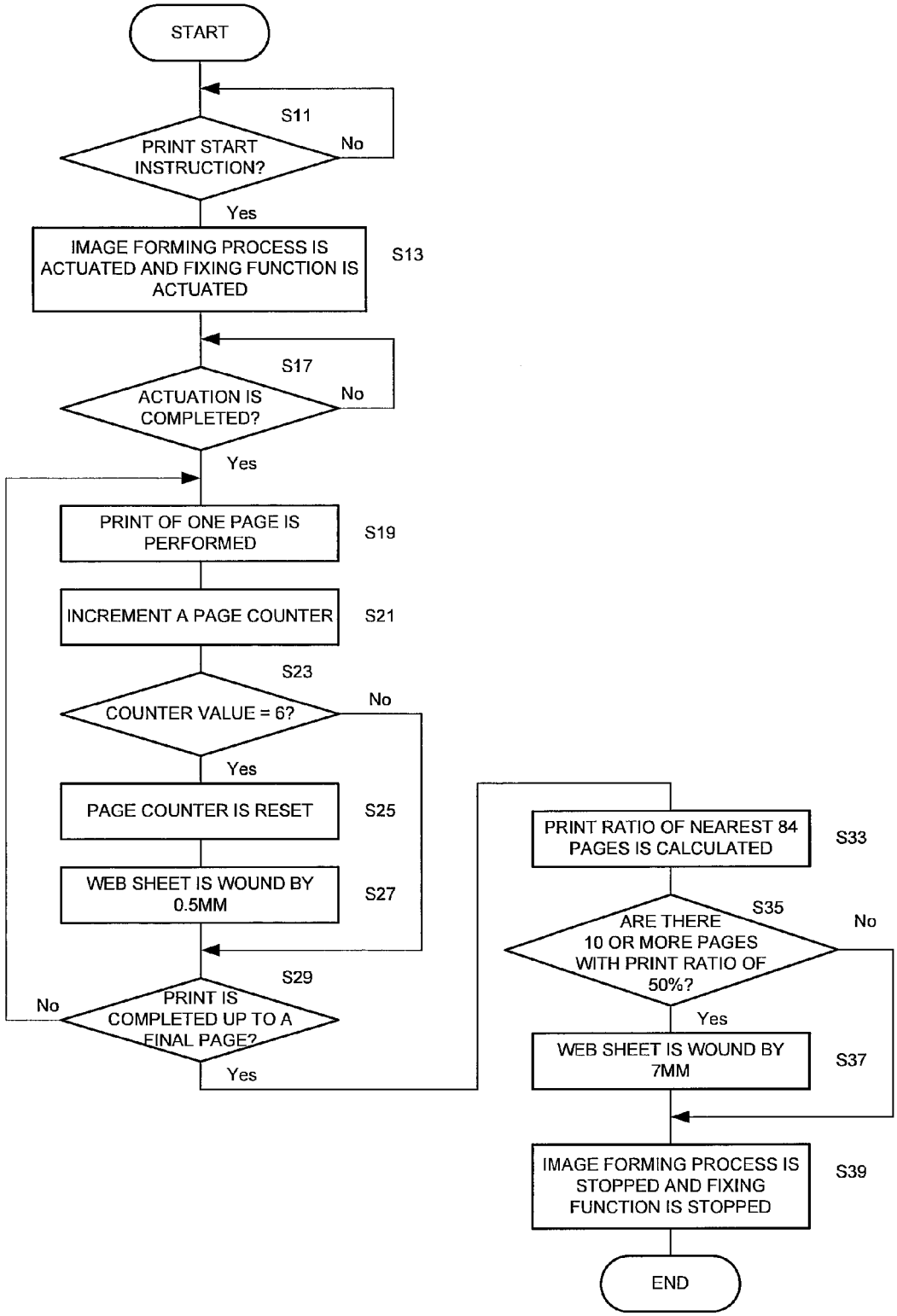
FIG. 6 is a flowchart showing a procedure of a winding control of the web sheet according to the present invention.

A control procedure for winding operation of the web sheet according to the present invention will be explained. Note that a detailed structure of the controller, being a main body that performs control, will be explained later. FIG. 6 is a flowchart showing a control procedure for a winding operation of the web sheet according to the present invention.

An outline of a winding control is as follows. The controller 240 controls winding of the web sheet, so as to feed 0.5 mm of the web sheet 133 for each print of 6 pages. After print is finished, the web sheet 133 of a length (7 mm) of the nip portion (cleaning nip portion 139) between the cleaning member (web sheet 133) and the heat roller 123 is fed to the web sheet 133, when the print ratio in a page just before (just before finishing the print) exceeds a prescribed value. Specifically, after print is finished, under the control of the controller 240, the web sheet 133 of the length (7 mm) of the nip (cleaning nip portion 139) portion between the cleaning member 133 and the heat roller 123 is fed, when there are prescribed number (10 pages) or more pages with a prescribed value (50%) or more of the print ratio (occupying ratio of black pixels in all pixels of one page) in each page.

The prescribed number of pages just before finishing the print is set to be 84 pages. This is because usually 0.5 mm of the web sheet 133 is fed for each print of 6 pages portion during print, and therefore the length 7 mm of the cleaning nip portion 139 corresponds to a feeding amount of 84 pages portion of the print pages. When the toner unwiped by the web sheet remains, the web sheet being fed by (7(mm)÷0.5(mm)×6(sheets)=84), namely, 84 pages (nip portion of 7 mm) just before completing the print, there is a high possibility that the toner remains in the present nip area.

The control procedure will be explained in detail along the flowchart of FIG. 6. The controller 240 waits for an operation performed by depressing a copy start button not shown of an image forming apparatus 100, or reception of print data from a personal computer (PC) connected to the image forming apparatus 100 via a communication line not shown. When either one of them is received, it is recognized as a print start instruction. The print is processed as a print job composed of one or more pages (a series of pages). When the print start instruction is given (Yes in step S11), an initialization operation of an image forming unit 103 is started. Namely, an image forming process is actuated (step S13). In addition, the initialization operation includes an actuation of a fixing function of the fuser unit 27, namely, includes a temperature control to a temperature capable of fixing the toner. Further, the controller 240 controls a motor 243 to be driven so that rotations of the heat roller and the pressure roller are started.

The controller 240 waits for a completion of actuation of an image forming process and a completion of an actuation of the fixing function (step S17). When these actuations are completed, the controller 240 performs print of one page portion (image formation (step S19). Then, the count of a page counter is added by one (step S21). The page counter counts the number of pages of a sheet passing through a fixing process. Note that the controller 240 resets the page counter and "n" winding number of times, when a new web sheet is fitted to the fuser unit. Further, the page counter determines whether a value of the page counter reaches 6 pages (step S23), and when the value of the page counter does not reach 6 pages, the routine is advanced to step S29 as will be described later. Meanwhile, when the page counter reaches 6 pages (Yes in step S23), the controller 240 resets the page counter (step S25), and winding operation of the web sheet is performed. In the winding operation, the controller 240 refers to a table based on a cumulative length of the feeding amount from "n" feeding number of times from the initial state, then calculates the rotation angle θ3 of the wind roller 137, and controls so that the wind roller 137 is rotated by θ3 by the wind roller driver 245 (step S27). Thus, 0.5 mm of the web sheet 133 is wound up. This winding quantity corresponds to a single winding operation. Then, 1 is added to the "n" number of times of the winding operation, which is then stored.

Next, in step S29, the controller 240 checks whether the print is performed up to the final page. When the print is not completed (No in step S29), the routine is returned to the aforementioned step S19, and the print of the next page is performed. Thus, the print of each page is repeated, until the print reaches the final page.

When the print up to the final page is completed (Yes in step S29), the print ratio of the prescribed number of pages just before (84 pages portion) is calculated (step S33), and whether there are 10 pages or more with 50% or more of the print ratio is determined (step S35). When a determination result shows Yes (Yes in step S35), the controller 240 refers to the table based on the cumulative length of the feeding amount from the "n" feeding number of times from the initial state, and calculates the rotation angle θ3 of the wind roller 137. Then, the controller 240 drives the wind roller driver 245 and controls the wind roller 137 to rotate by θ3. Here, the controller 240 controls the web sheet 133, so that 7 mm of the web sheet 133, which corresponds to the length of the cleaning nip portion 139, is fed. In this case, the feeding number of times corresponds to 14 numbers of times (7 mm÷0.5 mm of a single feeding number of time). Then, 14 is added to the "n" feeding number of times, which is then stored.

Thereafter, the controller 240 stops the image forming process. In addition, the controller 240 stops the fixing function (step S31). Namely, the drive of the motor 243 is stopped, so that the rotation of the fuser roller is stopped. Meanwhile, in the aforementioned step S35, when there are less than 10 pages with 50% or more of the print ratio (No in step S35), the image forming process is stopped without performing winding of the web sheet. In addition, the fixing function is stopped. Thus, one print job is finished.

Modified Example of Printing Amount Calculation

A modified example of a calculation method of a printing amount will be explained.

In a flowchart of FIG. 6, a calculation of the print ratio is directed to the prescribed page just before, when the image formation is finished. However, the calculation of the print ratio calculated in step S33 after completing the print, may be directed to the page constituting each print job.

Further, cumulated total value of the number of black pixels in the prescribed number of pages just before (in FIG. 6, 84 pages portion), and the obtained value may be the printing amount. When these modified examples are combined, four calculation methods can be considered. Namely, Calculation method 1: cumulated total value of print pixels This is the calculation method in which the number of black pixels in a series of image forming process is counted, then the number of black pixels formed in a series of all image forming process is accumulated and the cumulated total value of print pixels is calculated. Then, when the cumulated total value of print pixels exceeds a prescribed value, a new cleaning member is moved to the nip portion.

Calculation method 2: cumulated total value of black pixels in a prescribed number of pages before a series of image formation is completed This is the calculation method in which the number of black pixels is counted in the prescribed number of pages (example: 84 pages) before a series of image forming process is completed, then the number of black pixels in the prescribed number of pages is accumulated and the cumulated total value of print pixels is calculated. When the cumulated total value of print pixels exceeds the prescribed value, a new cleaning member is moved to the nip portion.

Calculation method 3: peak value of the print ratio 1

This is the calculation method in which the print ratio of each page in a series of image forming process is calculated, and when there are one or more pages in which the print ratio exceeds a prescribed value, a new cleaning member is moved to the nip portion.

Calculation method 4: peak value of the print ratio 2

This is the calculation method in which the print ratio of each page is calculated in the prescribed number of pages (example: 84 pages) before a series of image forming process is completed, and when there are one or more pages in which the print ratio exceeds a prescribed value, a new cleaning member is moved to the nip portion.

Modified Example of Web Sheet Winding Control

Figure 7:
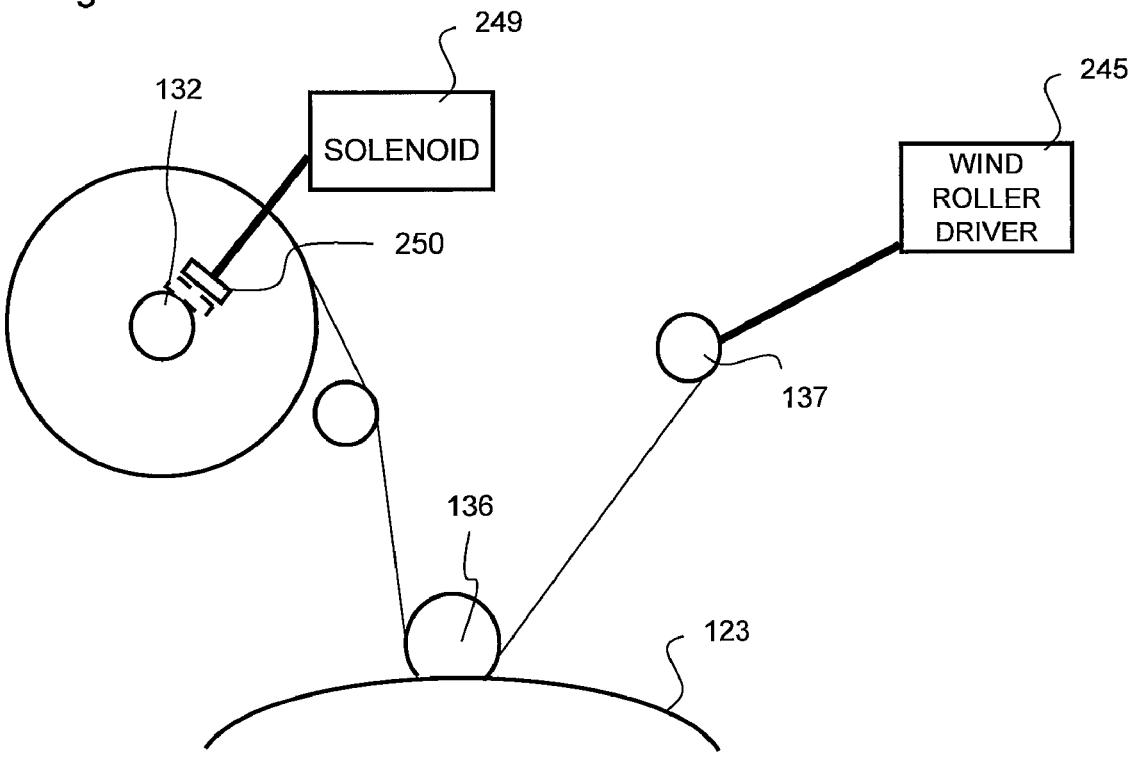
FIG. 7 is an explanatory view showing a modified example of the winding control of the web sheet, according to an embodiment of the present invention.

The modified example of the web sheet winding control is shown in FIG. 7.

In FIG. 7, the wind roller driver 245 drives the wind roller 137, so as to be rotated always at a constant speed. However, a slip mechanism is provided between the wind roller driver 245 and the wind roller 137. The feed roller 132 is a driven roller that rotates, as the web sheet 133 is wound up following after the rotation of the wind roller 137. A brake pad 250 is disposed in a shaft part of the feed roller 132 so as to be in contact with a shaft, and the brake pad 250 is engaged with a plunger of a solenoid 249.

Although the brake pad 250 is urged so as to abut on the shaft part, it separates from the shaft part by magnetizing the solenoid 249. When the web sheet is made to be stationary, the brake pad is set in contact with the feed roller 132. Thus, the braking force is applied to the rotation of the feed roller 132, and the web sheet becomes stationary, with tension applied thereto from the wind roller 137. The wind roller also stops by an action of a slip mechanism. When the solenoid 249 is magnetized, the feed roller 132 is rotated and the web sheet 133 is wound up. The controller 240 controls on (magnetization) and off of the solenoid.

By controlling a magnetization time of the solenoid, the winding quantity of the web sheet 133 can be controlled.

An Overall Structure of the Image Forming Apparatus

An overall structure of the image forming apparatus according to the present invention will be explained.

FIG. 1 is an outline view showing the overall structure of an embodiment of the image forming apparatus that executes a drive control method according to the present invention.

The image forming apparatus 100 shown in FIG. 1 forms an image by an electrophotographic image forming process in this embodiment, including an image bearing member (here, photoconductor drum)) 21, a charging unit 22 for charging the surface of the photoconductor drum 21, an exposure unit for forming an electrostatic latent image on the photoconductor drum 21 (here, an optical writing unit) 23, a developing unit 24 for developing the electrostatic latent image by a developer and forming a toner image on the photoconductor drum 21, a transfer unit 25 for transferring the toner image on the photoconductor drum 21 on a sheet (for example, a recording sheet and transparency sheet for OHP (overhead projector), a fuser device (here, fuser unit) 27 for fixing a transferred image on the sheet, a cleaning device (here, a drum cleaning unit) 26 for removing the toner remaining on the surface of the photoconductor drum 21 without being transferred by the transfer device 25, and a discharging unit (not shown) for discharging the charge remaining on the surface of the photoconductor drum 21.

Specifically, this image forming apparatus 100 acquires image data read from a document or acquires the image data received from outside, and forms a monochromatic image shown by this image data on the sheet, and a structure thereof is broadly classified into a document feeding section (ADF, namely, Automatic document feeder) 101, an image reading section 102, an image forming section 103, a sheet transporting section 104, and a sheet feeding section 105.

In the document feeding section 101, when at least one sheet of document is set in a document set tray 11, the document is pulled-out and fed from the document set tray 11 one by one, and this document is guided to and passed through a document reading window 102*a* of the image reading section 102, and this document is ejected to a sheet exit tray 12.

A CIS (Contact Image Sensor) 13 is disposed in an upper part of the document reading window 102*a*. The CIS13 repeatedly reads the image of a rear surface of the document in a main scanning direction when the document is passed through the document reading window 102*a*, and outputs the image data showing the image of the rear surface of the document.

In addition, when the document is passed through the document reading window 102*a*, the image reading section 102 exposes the surface of the document by a lamp of a first scanning unit 15, guides a reflected light from the surface of the document to an focusing lens 17 by mirrors of the first and second scanning units 15 and 16, and forms the image of the surface of the document on a CCD (Charge Coupled Device) 18. The CCD18 repeatedly reads the image of the surface of the document in the main scanning direction and outputs the image data showing the image of the surface of the document.

Further, when the document is placed on a platen glass on an upper surface of the image reading section 102, the first and second scanning units 15 and 16 are moved while maintaining a mutually prescribed speed relation, the surface of the document on the platen glass is exposed by the first scanning unit 15, the reflected light from the surface of the document is guided to the focusing lens 17 by the first and second scanning units 15 and 16, and the image on the surface of the document is formed on the CCD 18 by the focusing lens 17.

The image data outputted from the CIS 13 or the CCD 18 is subjected to each kind of image processing by an image processing unit 248 and is outputted to the image forming section 103.

The image forming section 103 records on the sheet a document image shown by the image data, including the already described photoconductor drum 21, charging unit 22, optical writing unit 23, developing unit 24, transfer unit 25, drum cleaning unit 26, and fuser unit 27, etc.

In the photoconductor drum 21, the surface is moved in a prescribed direction (direction shown by arrow A in the figure), this surface is cleaned by the drum cleaning unit 26, and the cleaned surface is uniformly charged by the charging unit 22. The charging unit 22 may be either of a corona charging type, and a roller type and brush type in contact with the photoconductor drum 21.

The optical writing unit 23 is a laser scanning unit (LSU) including two laser irradiation sections 28*a*, 28*b*, and two mirror groups 29*a*, 29*b*. In this optical writing unit 23, the image data is inputted and laser beam according to this image data is emitted from each laser irradiation sections 28*a*, 28*b* respectively, then the photoconductor drum 21 is irradiated with the laser beams via each mirror group 29*a*, 29*b* to expose the surface of the uniformly charged photoconductor drum 21, and the electrostatic latent image is formed on the surface of the photoconductor drum 21.

In order to respond to a high speed image forming process, this optical writing unit 23 adopts two beam system provided with two laser irradiation sections 28*a*, 28*b*, to reduce a load caused by speeding up of irradiation timing.

Note that as the optical writing unit 23, an EL writing head and an LED writing head, in which light emitting elements are arranged in an array, can also be used instead of a laser scanning unit.

The developing unit 24 supplies the toner to the photoconductor drum 21, then develops the electrostatic latent image, and forms the toner image on the surface of the photoconductor drum 21. The toner image on the surface of the photoconductor drum 21 is transferred to the sheet transported by the sheet transporting section 104. The fuser unit 27 heats and pressurizes the sheet to fix the toner image on the sheet. Thereafter, the sheet is further transported to the sheet exit tray 47 by the sheet transporting section 104 and is ejected. In addition, the drum cleaning unit 26 removes and recovers the toner remaining on the surface of the photoconductor drum 21 after development and transfer are performed.

Here, the transfer unit 25 includes a transfer belt 31, a drive roller 32, a driven roller 33, and an elastic conductive roller 34, etc, so that the transfer belt 31 is stretched and laid on each of the rollers 32 to 34 and other rollers to rotate these rollers. The transfer belt 31 has a prescribed resistance value (for example, $1\times10^{9}$ to $1\times10^{13}\Omega$/cm), and the sheet placed on its surface is transported. The elastic conductive roller 34 is pressed against the surface of the photoconductor drum 21 via the transfer belt 31, so that the sheet on the transfer belt 31 is pressed against the surface of the photoconductor drum 21. An electric field whose polarity is reverse to the charge of the toner image on the surface of the photoconductor drum 21 is applied to the elastic conductive roller 34, and by this electric field with reverse polarity, the toner image on the surface of the photoconductor drum 21 is transferred to the sheet on the transfer belt 31. For example, when the toner image has the charge of (−) polarity, the polarity of the electric field applied to the elastic conductive roller 34 is turned into (+) polarity.

The fuser unit 27 includes a pair of fuser rollers, being rotating bodies (here, the heat roller 123 and the pressure roller 124). A heat source is disposed inside of the heat roller 123, to set the surface of this heat roller 123 at a prescribed temperature (fixing temperature: approximately 160 to 200° C.). Moreover, a pressure member not shown is disposed on both ends of the pressure roller 124, so that the pressure roller 124 is set in press-contact with the heat roller 123 with a prescribed pressure. When the sheet is transported to a press-contact portion (called a fixing nip portion) between the heat roller 123 and the pressure roller 124, an unfixed toner image on the sheet is heat-melted and pressurized so that the toner image is fixed on the sheet, while feeding the sheet by each of the rollers 35 and 36.

The sheet transporting section 104 includes plural pairs of feed rollers 41 for feeding the sheet, a pair of registration rollers 42, a transport path 43, a reverse transport path 44, a plurality of branch claws 45, and a pair of eject rollers 46, etc.

In the transport path 43, the sheet is received from the sheet feeding section 105, and this sheet is transported until the tip end of the sheet reaches the registration rollers 42. At this time, the registration rollers 42 are stopped temporarily, and therefore the tip end of the sheet reaches and abuts on the registration rollers 42, to deflect the sheet. By an elastic force of the deflected sheet, the tip end of this sheet is aligned in parallel to the registration rollers 42. Thereafter, the rotation of the registration rollers 42 is started, to transport the sheet to the transfer unit 25 of the image forming section 103 by the registration rollers 42, and the sheet is further transported to the sheet exit tray 47 by the sheet exit rollers 46.

Stop and rotation of the registration rollers 42 are performed by switching a clutch between the registration rollers 42 and the drive shaft in an on-state and in an off-state, or by switching a motor, being a drive source of the registration rollers 42 in the on-state and the off-state.

In addition, when the image is recorded also on the rear surface of the sheet, a plurality of branch claws 45 are rotated, then branch claws of the transport path 43 and the reverse transport path 44 are switched, to turn over the surfaces of the sheet in the reverse transport path 44, and the sheet is returned to the registration rollers 42 of the transport path 43 via the reverse transport path 44. Thus, the image is also recorded on the rear surface of the sheet.

In the transport path 43 and the reverse transport path 44, a sheet detection sensor for detecting a position, etc, of the sheet is disposed in each place, and based on the position of the sheet detected by each sensor, the feed roller and the registration roller are drive-controlled, thus performing a transport and positioning of the sheet.

The sheet feeding section 105 is provided with a plurality of sheet feeding trays 51. Each sheet feeding tray 51 is a tray for storing the sheet, and is disposed in a lower part of the image forming apparatus 100. In addition, each sheet feeding tray 51 has a pickup roller, etc, for pulling out the sheet one by one, and sends the pulled-out sheet to the transport path 43 of the sheet transport section 104.

In the image forming apparatus 100 according to this embodiment, in order to perform a high speed image forming process, an interval between continuously transported sheets is made narrow (for example, the interval is made narrow to be about 50 mm). In addition, in the image forming apparatus 100 according to this embodiment, for the purpose of performing the high speed image forming process, each sheet feeding tray 51 has a loading capacity of 500 to 1500 sheets of a standard size.

Further, a large capacity sheet feeding cassette (LCC) 52 capable of storing a plurality of kinds of sheets in large volume, and a manual sheet feeding tray 53 for feeding mainly a sheet of a nonstandard size, are disposed on a side face of the image forming apparatus 100.

The sheet exit tray 47 is disposed on the side face of the image forming apparatus 100 on the opposite side to the manual sheet feeding tray 53. Instead of this sheet exit tray 47, a post-processing device (finisher) of an ejected sheet (staple and punch processing, etc) and a sheet exit tray of multiple stages can also be disposed as options.

Structure Related to a Control of a Fixing Function

Explanation will be given for a structure of a controller and a control of a fixing function according to the present invention. FIG. 5 is a block diagram showing a constitutional element related to the control of the fixing function of the fuser unit of FIG. 2.

The controller 240 includes a CPU (Central Processing Unit) 241 and a storing unit 242. The storing unit 242 stores a function required for each kind of control program, including an ROM(Read Only Memory) and a RAM(Random Access Memory).

The controller 240 reads each kind of control program from the storing unit 242 by the CPU 241, and by executing the read control program, performs control of the fixing function. Note that the controller 240 may control not only the fuser unit of FIG. 2 but also an entire operation of the image forming apparatus 100 of FIG. 1. In this case, the controller 240 further performs process control related to the image formation of the image forming apparatus 100. When the controller 240 performs only the control of the fuser unit, it may perform communication with the controller for controlling the entire operation of the image forming apparatus 100, and may control the fuser unit. The explanation given hereunder is based on an assumption that the entire operation of the image forming apparatus 100 is controlled by the controller 240.

Figure 5:
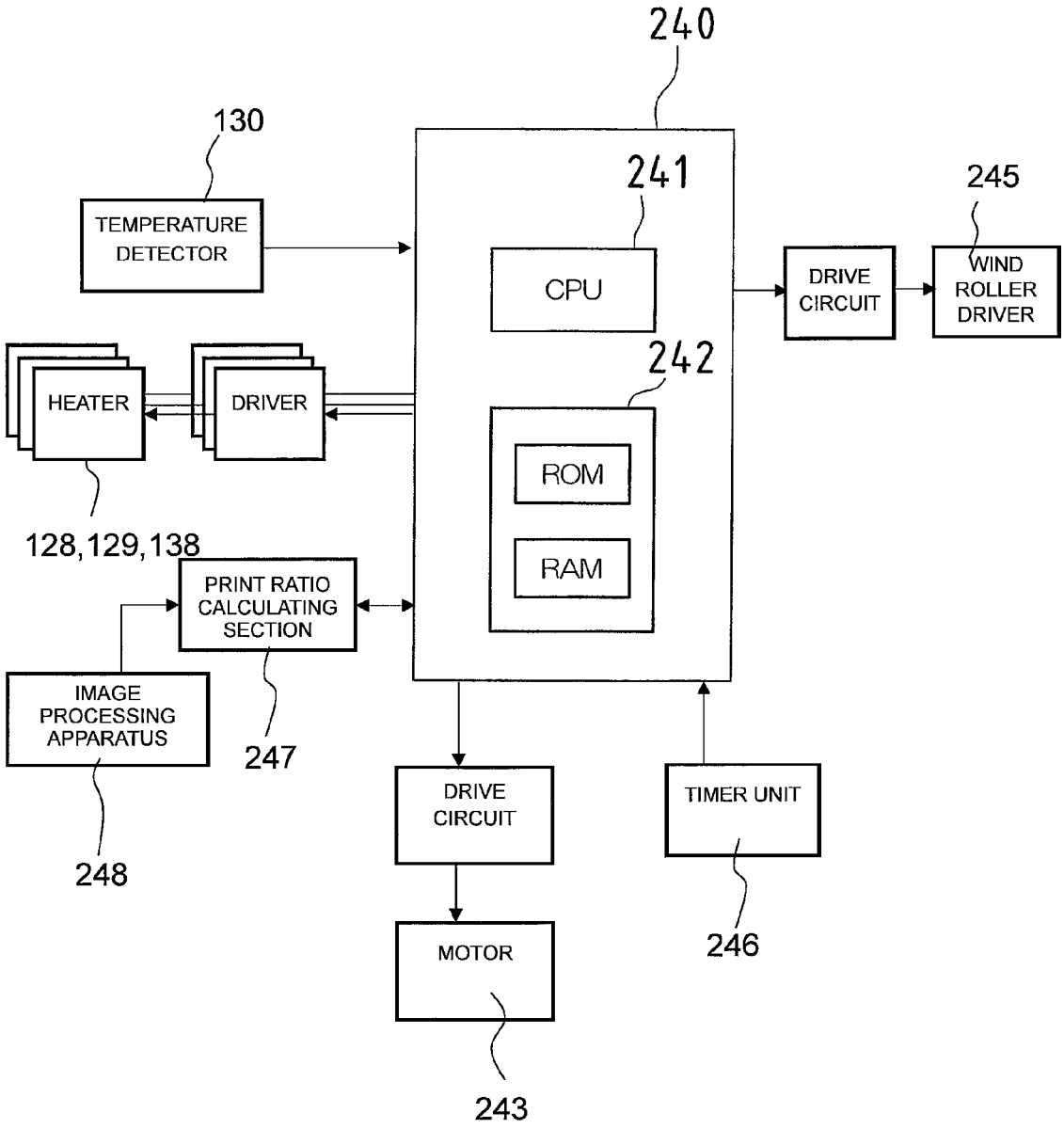
FIG. 5 is a block diagram showing a constituent element related to a control of a fixing function of a fuser unit of this invention shown in FIG. 2.

In FIG. 5, the motor 243 is a drive source for rotationally-driving the heat roller 123 and the pressure roller 124.

A temperature detector 130 is connected to the controller 240 so as to adjust a surface temperature of the heat roller and the pressure roller.

Heaters 128, 129, 138 are connected to the controller 240, via each driver. The controller 240 controls on/off of a power supply to the heater. Note that on/off of the power supply to the heaters 128, 129, 138 can be independently executed.

The wind roller driver 245 is a motor for driving the wind roller 137.

The timer unit 246 measures a drive time of the wind roller driver 245 and feeds the web sheet 133 of a prescribed length.

A print ratio calculation part 247 is a part that calculates the print ratio per one page, and the image processing apparatus 248 is connected to an output part that outputs a laser lighting signal to laser irradiation units 28*a* and 28*b*. Then, the number of black pixels per one page is calculated and a ratio of the black pixels in all numbers of pixels per one page is outputted to the controller 240. The controller 240 stores the print ratio of the prescribed number of pages (at least 84 pages portion) in the RAM. Here, in order to store the print ratio of 84 pages portion just before, out of the pages that has undergone image forming process, a place, where the print ratio of farthest past is stored, is deleted and a new print ratio is overwritten thereon, when the new print ratio is newly recorded.

Various modified examples are possible for the present invention, in addition to the above-described embodiments. However, these modified examples should not be interpreted as not belonging to the scope of the present invention. The present invention should include all modifications within the scope of the claims and in the meaning equivalent to the scope of the claims.

What is claimed is:

1. A fuser unit for an image forming apparatus which provides a fixing function of fusing a toner and fixing it on a recording sheet, the fuser unit comprising:

a fuser roller;

a web cleaning member that abuts on the fuser roller, and cleans its peripheral surface;

a press roller that presses the fuser roller via the cleaning member abutting on said peripheral surface of the fuser roller, and forms a cleaning nip portion which is an area where the cleaning member is pressed against the fuser roller;

a feed roller that feeds said cleaning member provided in an originally wound state;

a wind roller that winds the cleaning member therearound, which is fed from the feed roller and passes through said cleaning nip portion; and a controller that actuates the fixing function before an image formation is performed by the image forming apparatus, stops it after said image formation is performed, and rotates and stops the wind roller and/or the feed roller to control a winding quantity of the cleaning member, wherein said controller calculates a toner image amount based on a prescribed number of pages by tracking from a page on which an image is formed just before the image formation is completed, and controls so that when the calculated toner image amount is a predetermined amount or more, said cleaning member is wound around the wind roller during a non-fixing period after completing the image formation until next actuating the fixing function, and when said calculated toner image amount is less than the prescribed toner image amount, said cleaning member is not wound around the wind roller during said non-fixing period; and said controller further rotates the wind roller during said image formation, and said prescribed number of the pages is the number of pages on which the toner is fixed while a length of the cleaning member corresponding to a length of said cleaning nip portion is wound around the wind roller during said image formation.

2. The fuser unit according to claim 1, wherein the winding quantity of the cleaning member during the non-fixing period is a length of the cleaning member which corresponds to a length of said cleaning nip portion.

3. The fuser unit according to claim 2, wherein said controller controls said winding quantity of the cleaning member based on an initial radius of the cleaning member wound around the feed roller, an initial radius of the cleaning member wound around the wind roller, an average thickness of the cleaning member, and a cumulative total value obtained by cumulating angle of either the feed roller or the wind roller, having rotated since an initial rotation.

4. The fuser unit according to claim 3, further comprising:

a driver that rotates said wind roller in a winding direction at a prescribed speed, wherein said controller controls a rotation time of the wind roller rotated by the driver, thereby controlling said winding quantity.

5. The fuser unit according to claim 3, further comprising:

a tension mechanism that enables said wind roller to be capable of slipping, thereby giving tension to the cleaning member; and a braking unit that brakes or rotates said feed roller so that the rotation thereof is adjusted, wherein said controller changes a timing in which said braking unit brakes or rotates the feed roller, thereby controlling said winding quantity.

6. An image forming apparatus that comprises the fuser unit according to claim 1.

7. The image forming apparatus according to claim 6, further comprising:

an area coverage providing section that provides the controller in said fuser unit with a toner image coverage ratio of each page on which an image is formed, wherein said controller acquires the toner image coverage ratio of each page, calculates for each page an amount of a toner which is to be fixed to a recording sheet, based on the acquired toner image coverage ratio and a size of the page, and determines a sum of each calculated toner amount, as the toner image amount.

8. The image forming apparatus according to claim 6, further comprising:

an area coverage providing section that provides the controller in said fuser unit with a toner image coverage ratio of each page on which an image is formed, wherein said controller acquires the toner image coverage ratio of each page and determines the number of pages in which the acquired toner image coverage ratio exceeds a prescribed value as the toner image amount.

* * * * *